US008740211B2

(12) United States Patent
Kato

(10) Patent No.: US 8,740,211 B2
(45) Date of Patent: Jun. 3, 2014

(54) SHEET POST-PROCESSING APPARATUS THAT CARRIES OUT STAPLING PROCESS ON SHEET BUNDLE AND CONTROL METHOD THEREFOR

(71) Applicant: Canon Kabushiki Kaisha, Tokyo (JP)

(72) Inventor: Hitoshi Kato, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/755,172

(22) Filed: Jan. 31, 2013

(65) Prior Publication Data

US 2013/0193629 A1 Aug. 1, 2013

(30) Foreign Application Priority Data

Jan. 31, 2012 (JP) ..... 2012-018341

(51) Int. Cl.
*B65H 37/04* (2006.01)
*B41L 43/12* (2006.01)

(52) U.S. Cl.
USPC ..... 270/37; 270/32; 270/58.07; 270/58.08; 270/58.09; 270/58.12; 270/58.17

(58) Field of Classification Search
USPC ..... 270/32, 37, 52.18, 58.07, 58.08, 58.09, 270/58.11, 58.12, 58.17, 58.27; 412/11, 18; 399/407, 408, 410
See application file for complete search history.

(56) References Cited

U.S. PATENT DOCUMENTS 6,634,633 B1 * 10/2003 Maruchi ..... 270/58.33
6,886,824 B2 * 5/2005 Johdai et al. ..... 270/58.33
2013/0001847 A1 * 1/2013 Kato et al. ..... 270/58.09

FOREIGN PATENT DOCUMENTS

JP 2005-263441 A 9/2005

* cited by examiner

*Primary Examiner* — Leslie A Nicholson, III
(74) *Attorney, Agent, or Firm* — Rossi, Kimms & McDowell LLP

(57) ABSTRACT

A sheet post-processing apparatus which is capable of preventing a stapling position and a folding position from being out of alignment when a stapling process is carried out. A sheet bundle, which is stacked in a housing guide, is stapled by a stapler using a staple at the stapling position. The sheet bundle is folded at a position of the staple after the stapling. After the stapling, the sheet bundle is moved from the stapling position to the folding position. During the movement, the staple is detected using a staple sensor disposed at a predetermined location between the stapling position and the folding position. Based on a moving distance of the sheet bundle before the staple is detected after the stapling process, a position of the sheet bundle with respect to the stapler for stapling on a subsequent sheet bundle is corrected.

8 Claims, 8 Drawing Sheets

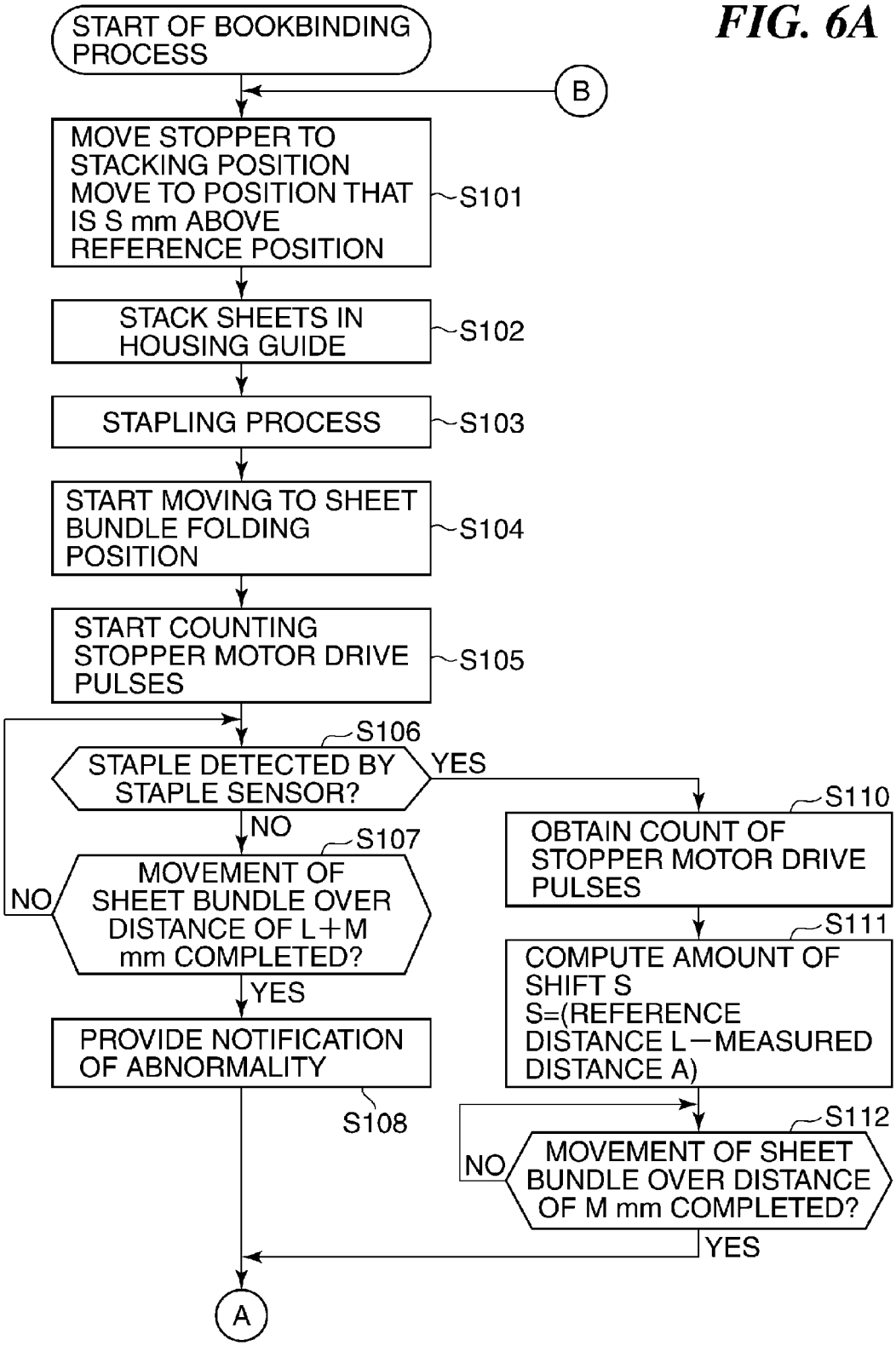
FIG. 6A
START OF BOOKBINDING PROCESS
B
MOVE STOPPER TO STACKING POSITION MOVE TO POSITION THAT IS S mm ABOVE REFERENCE POSITION
S101
STACK SHEETS IN HOUSING GUIDE
S102
STAPLING PROCESS
S103
START MOVING TO SHEET BUNDLE FOLDING POSITION
S104
START COUNTING STOPPER MOTOR DRIVE PULSES
S105
S106
STAPLE DETECTED BY STAPLE SENSOR?
YES
NO
S107
MOVEMENT OF SHEET BUNDLE OVER DISTANCE OF L+M mm COMPLETED?
NO
YES
PROVIDE NOTIFICATION OF ABNORMALITY
S108
S110
OBTAIN COUNT OF STOPPER MOTOR DRIVE PULSES
S111
COMPUTE AMOUNT OF SHIFT S S=(REFERENCE DISTANCE L−MEASURED DISTANCE A)
S112
MOVEMENT OF SHEET BUNDLE OVER DISTANCE OF M mm COMPLETED?
NO
YES
A

SHEET POST-PROCESSING APPARATUS THAT CARRIES OUT STAPLING PROCESS ON SHEET BUNDLE AND CONTROL METHOD THEREFOR

BACKGROUND OF THE INVENTION

1. Field of the Invention

The present invention relates to a sheet post-processing apparatus that carries out post-processing on a sheet bundle and a control method therefor, and in particular to a sheet post-processing apparatus for carrying out a stapling process on a sheet bundle.

2. Description of the Related Art

In general, after image formation on sheets (printing) is carried out, two or more sheets are bundled, and an end of the sheet bundle is stapled (stitched) at one or a plurality of positions. Further, so-called saddle stitching may be carried out in which a sheet bundle is stitched in a central part thereof in a conveying direction and then folded in two in the stitched part. Also, so-called side stitching in which an end of a sheet bundle is stitched may be carried out. To carry out such a stapling process, a so-called sheet post-processing apparatus is used.

In the stapling process described above, a stapler drives a metallic staple through a sheet bundle to staple the sheet bundle. However, there may be cases where a staple is not driven through a sheet bundle for some reason. When a sheet bundle through which a staple has not been driven is discharged from the sheet post-processing apparatus, a user needs to manually staple the sheet bundle. As a result, post-processing efficiency significantly decreases.

To address such a problem, for example, a metallic sensor (staple presence-absence sensor) is provided in a sheet conveying path so that the metallic sensor detects whether or not a staple has been driven through a sheet bundle (see Japanese Laid-Open Patent Publication (Kokai) No. 2005-263441).

According to Japanese Laid-Open Patent Publication (Kokai) No. 2005-263441, however, whether or not there is a staple in a sheet bundle is merely detected, and no consideration is given to how a staple can be accurately put at a predetermined stapling position after a stapling process.

In particular, when a user operates a stapler in, for example, exchanging staples, the position of the stapler may slightly change. As a result, for example, a folding position and a position of a staple in saddle stitching may be out of alignment, and a bound book may be poor-looking.

SUMMARY OF THE INVENTION

The present invention provides a sheet post-processing apparatus and a control method therefor which are capable of preventing a stapling position and a folding position from being out of alignment when a stapling process is carried out.

Accordingly, a first aspect of the present invention provides a sheet post-processing apparatus that carries out a stapling process on a plurality of sheets, comprising a sheet stacking unit configured to have the plurality of sheets stacked thereon as a sheet bundle, a sheet stapling unit configured to stapling the sheet bundle, stacked on the sheet stacking unit, using a binding needle at a stapling process position at which the stapling process is carried out, a folding process unit configured to, after the stapling process, carry out a folding process in which the sheet bundle is folded at a position of the binding needle, a binding needle detection unit configured to be disposed at a predetermined location between the stapling process position and a folding process position at which the folding process is carried out, and detect the binding needle, a sheet bundle moving unit configured to move the sheet bundle from the stapling process position to the folding process position, and a correction unit configured to, based on a moving distance of the sheet bundle before the binding needle is detected by the binding needle detection unit after the stapling process by the sheet stapling unit, correct a position of the sheet bundle with respect to the sheet stapling unit in the stapling process for a subsequent sheet bundle.

Accordingly, a second aspect of the present invention provides a control method for a sheet post-processing apparatus that has a sheet stacking unit having a plurality of sheets stacked thereon as a sheet bundle; carries out a stapling process on the sheet bundle, comprising a sheet stapling step of driving a stapler to staple the sheet bundle, stacked on the sheet stacking unit, using a binding needle at a stapling process position at which the stapling process is carried out, a folding process step of carrying out a folding process in which the sheet bundle is folded at a position of the binding needle after the stapling process, a moving step of, after the stapling process, moving the sheet bundle from the stapling process position to the folding process position, a binding needle detection step of, during the movement in the moving step, detecting the binding needle using a binding needle sensor disposed at a predetermined location between the stapling process position and a folding process position at which the folding process is carried out, and a correction step of, based on a moving distance of the sheet bundle before the binding needle is detected by the binding needle sensor after the stapling process, correcting a position of the sheet bundle with respect to the stapler in the stapling process for a subsequent sheet bundle.

According to the present invention, a stapling position and a folding position can be reliably prevented from being out of alignment when a stapling process is carried out.

Further features of the present invention will become apparent from the following description of exemplary embodiments (with reference to the attached drawings).

BRIEF DESCRIPTION OF THE DRAWINGS

FIGS. 3A to 3C are views useful in explaining a staple sensor appearing in FIG. 2, in which FIG. 3A shows an arrangement of the staple sensor, FIG. 3B shows a state where the absence of a staple is detected, and FIG. 3C shows a state where the presence of a staple is detected.

FIGS. 4A and 4B are views useful in explaining a circuit arrangement of the staple sensor appearing in FIG. 2, in which FIG. 4A is a block diagram thereof, and FIG. 4B is a diagram useful in explaining how a staple is detected.

FIGS. 6A and 6B are flowcharts useful in explaining sheet post-processing carried out by a sheet post-processing apparatus controller appearing in FIG. 5.

DESCRIPTION OF THE EMBODIMENTS

A description will now be given of a sheet post-processing apparatus according to an embodiment of the present invention with reference to the drawings.

Figure 1:
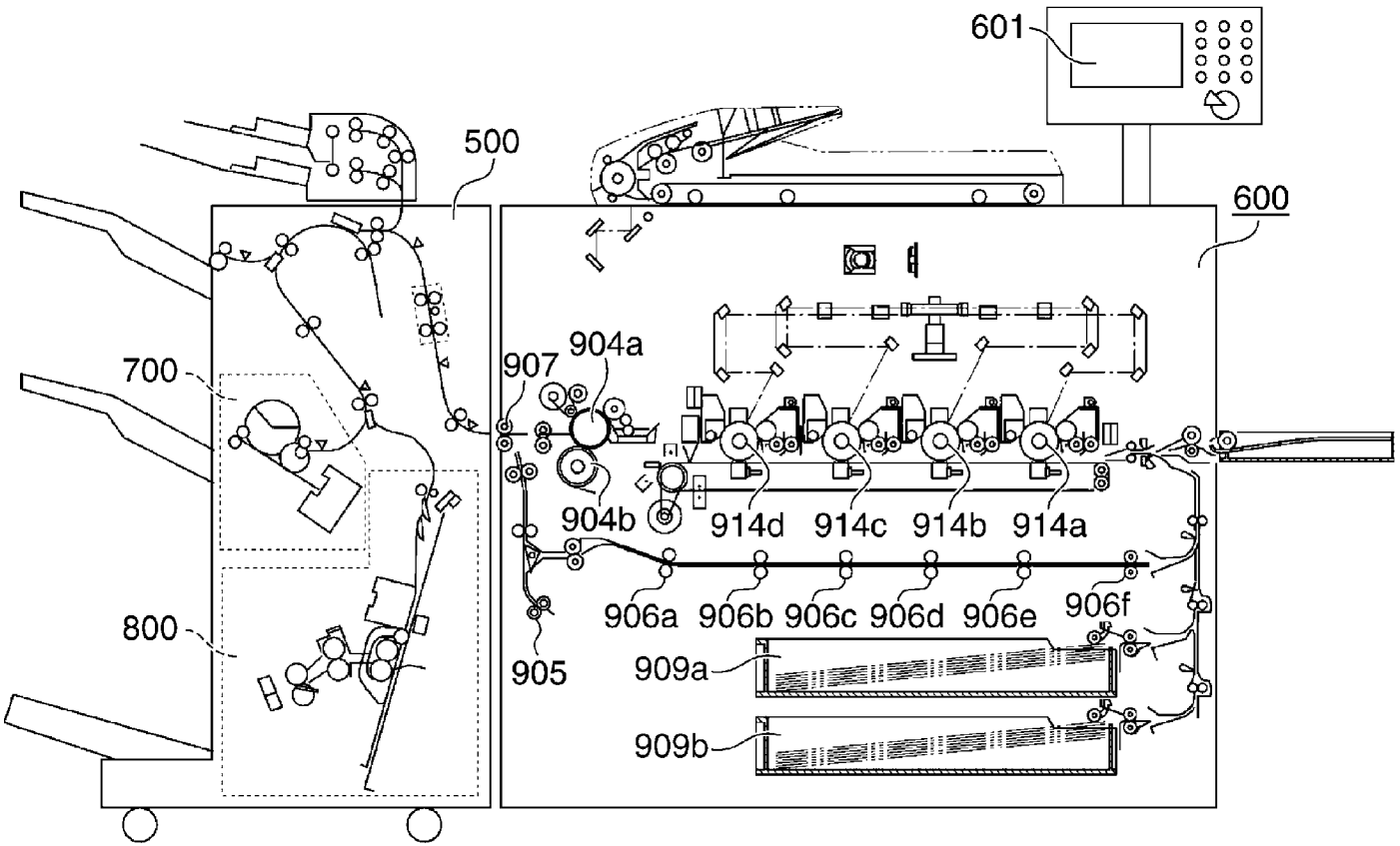
FIG. 1 is a view showing an exemplary image forming apparatus having a sheet post-processing apparatus according to an embodiment of the present invention.

FIG. 1 is a view showing an exemplary image forming apparatus having the sheet post-processing apparatus according to the embodiment of the present invention.

The image forming apparatus shown in the figure has an image forming apparatus main body 600 and the sheet post-processing apparatus 500. In the example shown in the figure, the image forming apparatus main body 600 carries out monochrome or color image formation. The sheet post-processing apparatus 500 is connected to the image forming apparatus main body 600. Here, a saddle stitching apparatus that is an exemplary sheet post-processing apparatus 500 is connected to the image forming apparatus main body 600.

After image formation on a sheet is carried out by the image forming apparatus main body 600, sheets are conveyed to the saddle stitching apparatus 500 and saddle-stitched there. It should be noted that when the saddle stitching apparatus 500 is not connected to the image forming apparatus main body 600, sheets on which images have been formed are discharged from the apparatus from a discharge port. The saddle stitching apparatus 500 may be integrated as a sheet discharging apparatus into the image forming apparatus main body 600.

The image forming apparatus main body 600 has an operation unit 601 for use in doing various inputs and configuring various settings. Here, a position at which a user faces a screen of the operation unit 601 is referred to as the front side, and a back side is referred to as the rear side.

The image forming apparatus main body 600 has an image formation unit equipped with a yellow (Y) photosensitive drum 914*a*, a magenta (M) photosensitive drum 914*b*, a cyan (C) photosensitive drum 914*c*, and a black (K) photosensitive drum 914*d*.

Toner images of the four colors consisting of a Y toner image, an M toner image, a C toner image, and a K toner image are transferred in sequence from the Y photosensitive drum 914*a*, the M photosensitive drum 914*b*, the C photosensitive drum 914*c*, and the K photosensitive drum 914*d*, respectively, onto a sheet (recording sheet) supplied from a cassette 909*a* or 909*b*. Namely, color toner images are formed on the sheet.

The sheet having the color toner images formed thereon is conveyed to a fixing unit, and the color toner images are fixed on the sheet by a pressure roller 904*a* and a fixing roller 904*b*.

In a single-sided image formation mode (single-sided printing mode), the sheet is discharged from the image forming apparatus main body 600 by a discharging roller pair 907 after fixing.

On the other hand, in a double-sided image formation mode (double-sided printing mode), the sheet is conveyed to inverting rollers 905 after fixing. When a trailing end of the sheet in a conveying direction has passed an inverting flapper unit (not shown), the inverting rollers 905 rotate backward. As a result, the sheet is conveyed on a conveying path by double-sided conveying rollers 906*a* to 906*f* to reach the image forming unit again. Then, color toner images are formed on a rear surface of the sheet.

Thereafter, the sheet is conveyed to the fixing unit, and the color toner images are fixed on the sheet there. The sheet is then discharged from the image forming apparatus main body 600 by the discharging roller pair 907.

Figure 2:
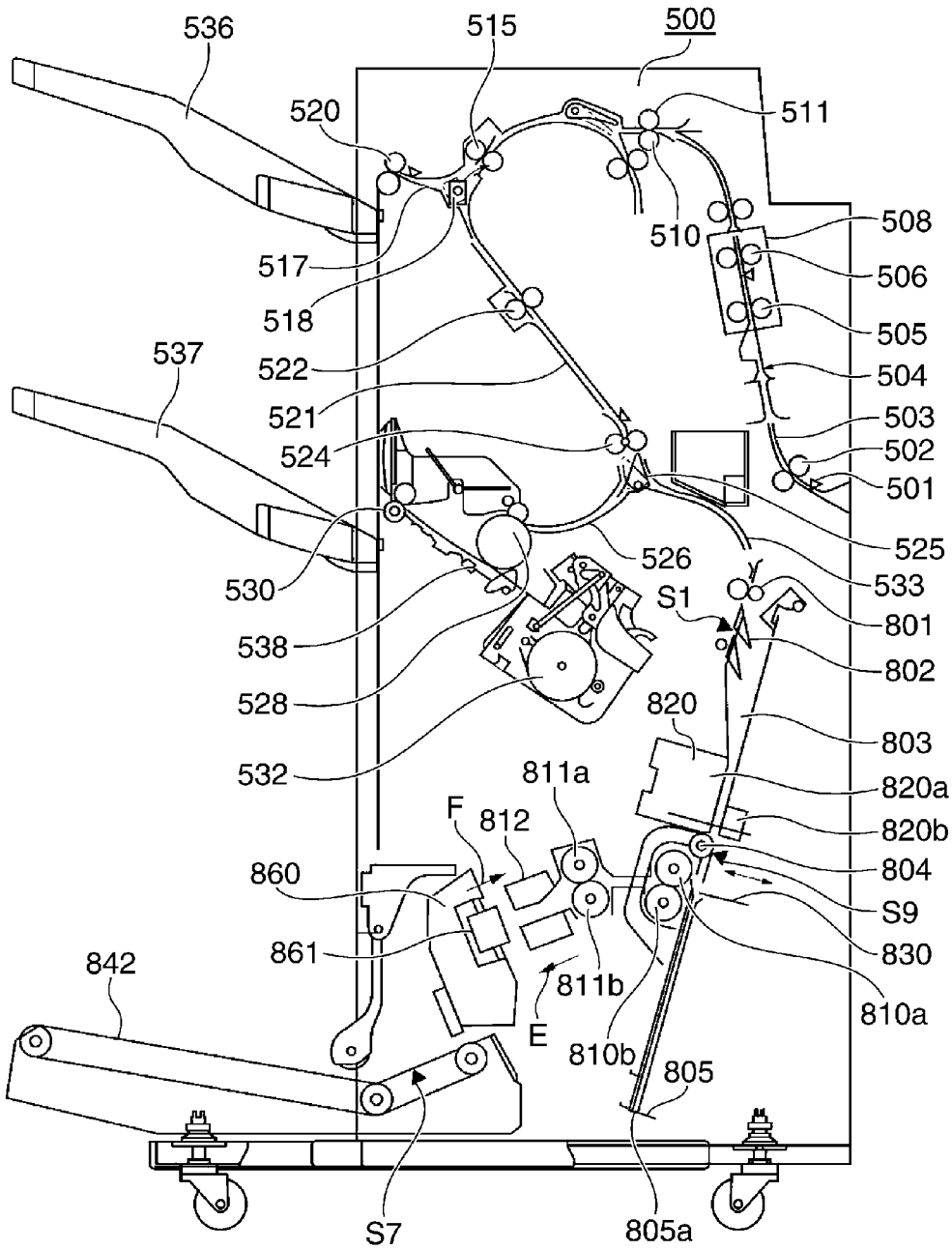
FIG. 2 is a view showing in detail an arrangement of the sheet post-processing apparatus (saddle stitching apparatus) appearing in FIG. 1.

FIG. 2 is a view showing in detail an arrangement of the saddle stitching apparatus 500 appearing in FIG. 1.

Referring to FIGS. 1 and 2, the saddle stitching apparatus 500 has a side stitching unit 700 and a saddle stitching unit 800. When post-processing (for example, bookbinding) is to be carried out, a sheet S is conveyed from the image forming apparatus main body 600 to the saddle stitching apparatus 500.

In the saddle stitching apparatus 500, the sheet S is delivered to an entrance roller pair 502. On this occasion, the delivery timing of the sheet S is detected by an entrance sensor 501. When the sheet S is conveyed through a conveying path 503, an end position of the sheet S in a width direction perpendicular to a sheet conveying direction is detected by a sheet end sensor 504. When the sheet S is being conveyed, the sheet end sensor 504 detects an error in the width direction from a conveyance center position.

After the error in the width direction is detected, the sheet S is conveyed to a shift unit 508. The shift unit 508 has shift roller pairs 505 and 506. When the sheet S is being conveyed by the shift roller pairs 505 and 506, the shift unit 508 moves toward the front side or the rear side according to the result of detection by the sheet end sensor 504 to shift the sheet S in the width direction.

Thereafter, the sheet S is conveyed by a conveying roller 510 to reach a buffer roller pair 515. When the sheet S is to be discharged onto an upper discharge tray 536, an upper path switching member 518 is driven by a drive part (not shown) such as a solenoid to guide the sheet S onto an upper path conveying path 517. The sheet S is then discharged onto the upper discharge tray 536 by an upper sheet discharging roller pair 520.

When the sheet S is not to be discharged onto the upper discharge tray 536, the sheet S is guided to a bundle conveying path 521 by the upper path switching member 518. The sheet S is then conveyed by a buffer roller pair 522 and a bundle conveying roller pair 524.

When the sheet S is to be subjected to a saddle (saddle stitching) process, a saddle path switching member 525 is caused to move by a drive part (not shown) such as a solenoid. As a result, the sheet S is conveyed to a saddle path 533. The sheet S is guided to the saddle stitching unit 800 by a saddle entrance roller pair 801 and subjected to the saddle stitching process (saddle process).

When the sheet S is to be discharged onto a lower discharge tray 537, the sheet S is conveyed to a lower path 526 by the saddle path switching member 525. Thereafter, the sheet S is discharged onto a processing tray (sheet stacking unit or sheet stacking part) 538 by a lower discharging roller pair 528. A plurality of sheets S are stacked on this processing tray 538, and a sheet bundle is subjected to a stapling process on the processing tray 538 by a stapler 532. The sheet bundle is then discharged onto the lower discharge tray 537 by a discharging roller pair 530.

Next, a description will be given of the saddle stitching unit 800 appearing in FIG. 1.

When the sheet S is conveyed to the saddle stitching unit 800, it is passed to the saddle entrance roller pair 801 first. Then, a bring-in entrance for the sheet S is selected according to its size by a switching member 802 driven by a solenoid, and the sheet S is brought into a housing guide 803. The housing guide 803 is tilted so that a downstream side in the direction in which the sheet S is conveyed can be lower than an upstream side. The sheet S brought into the housing guide 803 is conveyed by a slip roller 804 whose surface is slippery.

The saddle entrance roller pair 801 and the slip roller 804 are driven by a saddle stitching entrance roller motor (not shown) and controlled according to results of detection by a saddle stitching entrance sensor (not shown). The sheet S is conveyed until its end (lower end in the conveying direction) abuts on an end stopper 805 that has moved to a predetermined position in advance according to a sheet size (a length of the sheet S in the conveying direction).

The end stopper 805 is controlled according to results of detection by an stopper sensor S2 (see FIG. 5) and capable of moving in the sheet conveying direction along a sheet guide surface of the housing guide 803. A stopper motor (not shown) causes the end stopper 805 to move in the direction in which the sheet S is conveyed.

The end stopper 805 has a restraining surface 805*a* that projects out from the housing guide 803, and the restraining surface 805*a* receives and holds an end of the sheet S conveyed to the housing guide 803 on a downstream side in the conveying direction. In the above described way, the sheets S are stacked as a sheet bundle in the housing guide 803.

A stapler 820 is disposed part way along the housing guide 803. The stapler 820 acts as a stapling unit that staples a central part of a sheet bundle, which is housed in the housing guide 803, in the conveying direction. The stapler 820 has a driver 820*a* and an anvil 820*b*, which are disposed so as to face each other and sandwich the housing guide 803. The driver 820*a* ejects a staple to the sheet bundle, and the anvil 820*b* bends the ejected staple.

A staple sensor (staple detection unit or staple sensor) S9 that detects a staple (binding needle) in a sheet bundle is disposed downstream of the stapler 820. It should be noted that a description of the staple sensor S9 will be given later.

A pair of folding rollers 810*a* and 810*b* and an ejecting member 830 are disposed so as to face each other and sandwich the housing guide 803. The pair of folding rollers 810*a* and 810*b* and the ejecting member 830 are used in folding a sheet bundle, which is housed in the housing guide 803, in two in the middle in the conveying direction (that is, at the position of a staple).

The ejecting member 830 lies at a home position (HP) away from the housing guide 803. At the time of folding a sheet bundle in the middle, an ejecting motor (not shown) causes the ejecting member 830 to eject toward a center part of the sheet bundle in the conveying direction housed in the housing guide 830.

As a result, the ejecting member 830 folds the sheet bundle in two in the middle while pushing the sheet bundle into a nip between the pair of folding rollers 810*a* and 810*b*. Namely, the ejecting member 830 and the pair of folding rollers 810*a* and 810*b* act as a sheet folding unit.

It should be noted that the HP is detected by an ejecting sensor (not shown), and the amount of ejection is detected by an ejecting encoder sensor (not shown) that detects the rotational amount of the ejecting motor. When a sheet bundle is to be folded in the middle, the end stopper 805 is lowered to move the sheet bundle downward as viewed in the figure so that the ejecting member 830 can abut on a central part of the sheet bundle.

A creased sheet bundle is conveyed by a pair of first folding conveying rollers 811*a* and 811*b* and a pair of second folding conveying rollers 812*a* and 812*b* until a leading end of the sheet bundle reaches a pressing unit 860. When the leading end reaches the pressing unit 860, the sheet bundle stops.

While causing a pressing roller pair 861 to press the spine of the folded sheet bundle (book) of which conveyance has been stopped, the pressing unit 860 moves the pressing roller pair 861 along the fold in the book. Thus, the pressing unit 860 carries out a fold reinforcing process on the fold. After the fold reinforcing process is carried out by the pressing unit 860, the book is conveyed downstream and discharged onto a folded bundle discharge tray 842 (discharge unit).

In the folded bundle discharge tray 842, a discharge tray motor (not shown) rotatively moves a conveyer on a tray surface. Sheet bundles discharged from turning-on to turning-off of a discharge tray sensor S7 are successively moved downstream and stacked. It should be noted that the bundle discharge tray sensor S7 is turned on when it detects a sheet bundle.

It should be noted that when a result of detection by the staple sensor S9 indicates the absence of a staple, discharging of the sheet bundle is continued for some time as will be described later even after the discharge tray sensor S7 changes from the ON state to the OFF state so that the sheet bundle can be easily distinguished from the next sheet bundle.

Figure 3A:
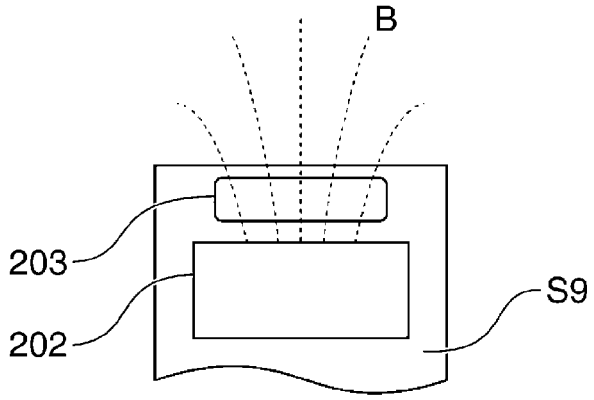
Figure 3B:
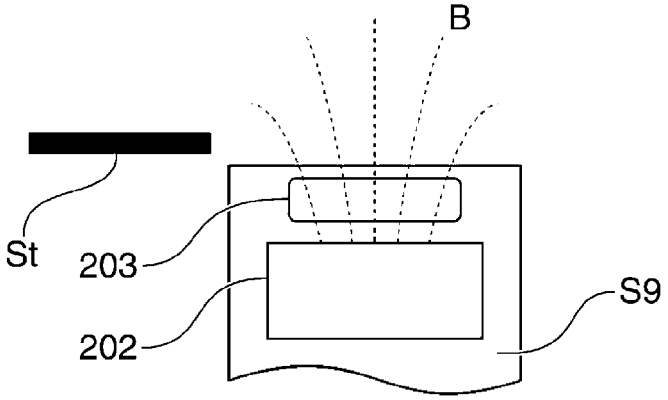
Figure 3C:
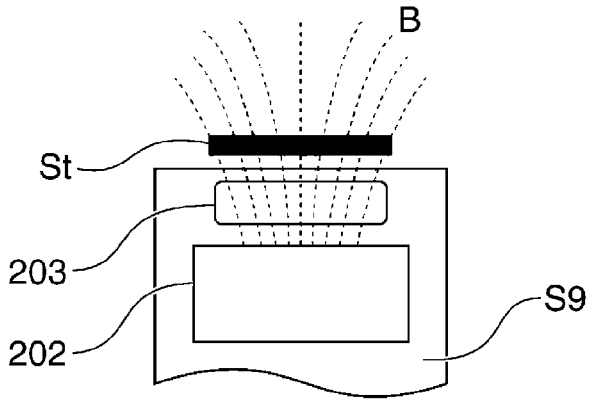

FIGS. 3A to 3C are views useful in explaining the staple sensor S9 appearing in FIG. 2. FIG. 3A shows an arrangement of the staple sensor S9, FIG. 3B shows a state where the absence of a staple is detected, and FIG. 3C shows a state where the presence of a staple is detected.

Referring to FIG. 3A, the staple sensor S9 has a permanent magnet 202 and a magnetoresistive element 203. The magnetoresistive element 203 detects magnetic fluxes B from the permanent magnet 202. Namely, the magnetoresistive element 203 detects a change in magnetic flux density when a magnetic substance passes along a detection surface of the staple sensor S9.

The magnetoresistive element 203 has the property that the magnetic resistance value increases as magnetic fluxes B passing through the magnetoresistive element 203 increase, and the magnetic resistance value decreases as magnetic fluxes B passing through the magnetoresistive element 203 decrease. As will be described later, the staple sensor S9 converts a magnetic resistance value of the magnetoresistive element 203 into an electric signal, amplifies the electric signal by an amplification circuit to obtain an output, and detects the presence or absence of a staple according to the output.

As shown in FIG. 3B, assuming now that the staple St lies at a position away from the staple sensor S9, the number of magnetic fluxes B passing through the magnetoresistive element 203 remains relatively small. Thus, the magnetic resistance value of the magnetoresistive element 203 is small.

On the other hand, when the staple St lies above the detection surface of the staple sensor S9, the number of magnetic fluxes B passing through the magnetoresistive element 203 is large. Accordingly, the magnetic resistance value of the magnetroresistive element 203 is large. Thus, the presence or absence of a staple St can be detected based on a change (difference) in the magnetic resistance value of the magnetoresistive element 203.

Figure 4A:
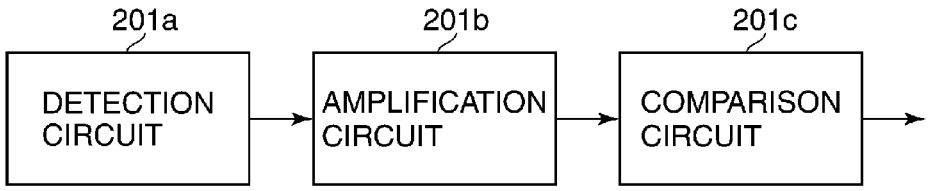
Figure 4B:
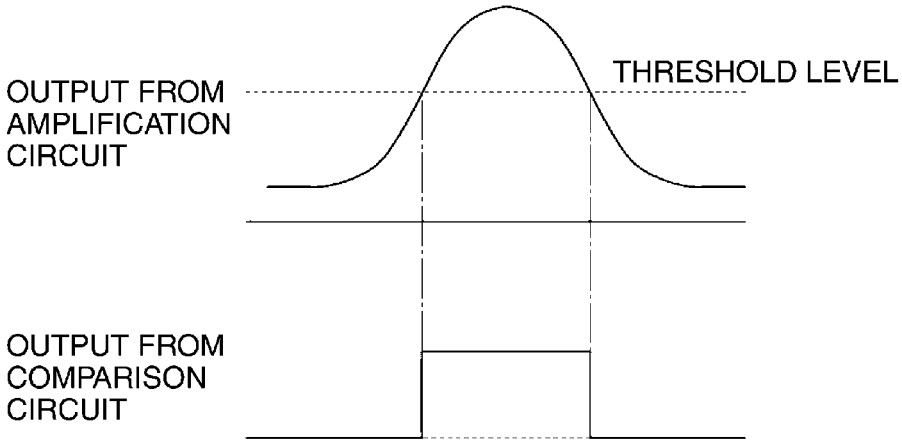

FIGS. 4A and 4B are views useful in explaining a circuit arrangement of the staple sensor S9 appearing in FIG. 2. FIG. 4A is a block diagram, and FIG. 4B is a diagram useful in explaining how the staple is detected.

Referring to FIGS. 4A and 4B, the staple sensor S9 has a detection circuit 201*a*, an amplification circuit 201*b*, and a comparison circuit 201*c*. As described earlier, the magnetic resistance value of the magnetoresistive element 203 varies according to the position of a staple St. For example, the detection circuit 201*a* applies a predetermined voltage to the magnetoresistive element 203 and outputs a current value, which is responsive to a change in magnetic resistance value, as an electric signal (analog signal).

The amplification circuit 201*b* amplifies the analog signal, which is output from the detection circuit 201*a*, using a predetermined gain and outputs an amplified signal. The comparison circuit 201*c* compares a level of the amplified signal with a predetermined threshold level and determines whether or not the level of the amplified signal is greater than the threshold level. When the level of the amplified signal is greater than the threshold level, the comparison circuit 201*c* outputs a high (H)-level signal, and when the level of the amplified signal is equal to or smaller than the threshold level, the comparison circuit 201*c* outputs a low (L)-level signal. A sheet post-processing apparatus controller, to be described later, determines whether or not a staple St is present according to a difference between the H level signal (for example, +5V) and the L level signal (for example, 0V).

It should be noted that although in the above described example, a metallic sensor of a magnetic type is used as the staple sensor S9, a sensor that detects a staple through passage of electric current may be used as the staple sensor S9. Further, a capacitive sensor may be used as the staple sensor S9, and also, a lever may be brought into contact with a sheet surface, and whether or not there is a staple may be determined according to projections and depressions of the sheet surface.

Figure 5:
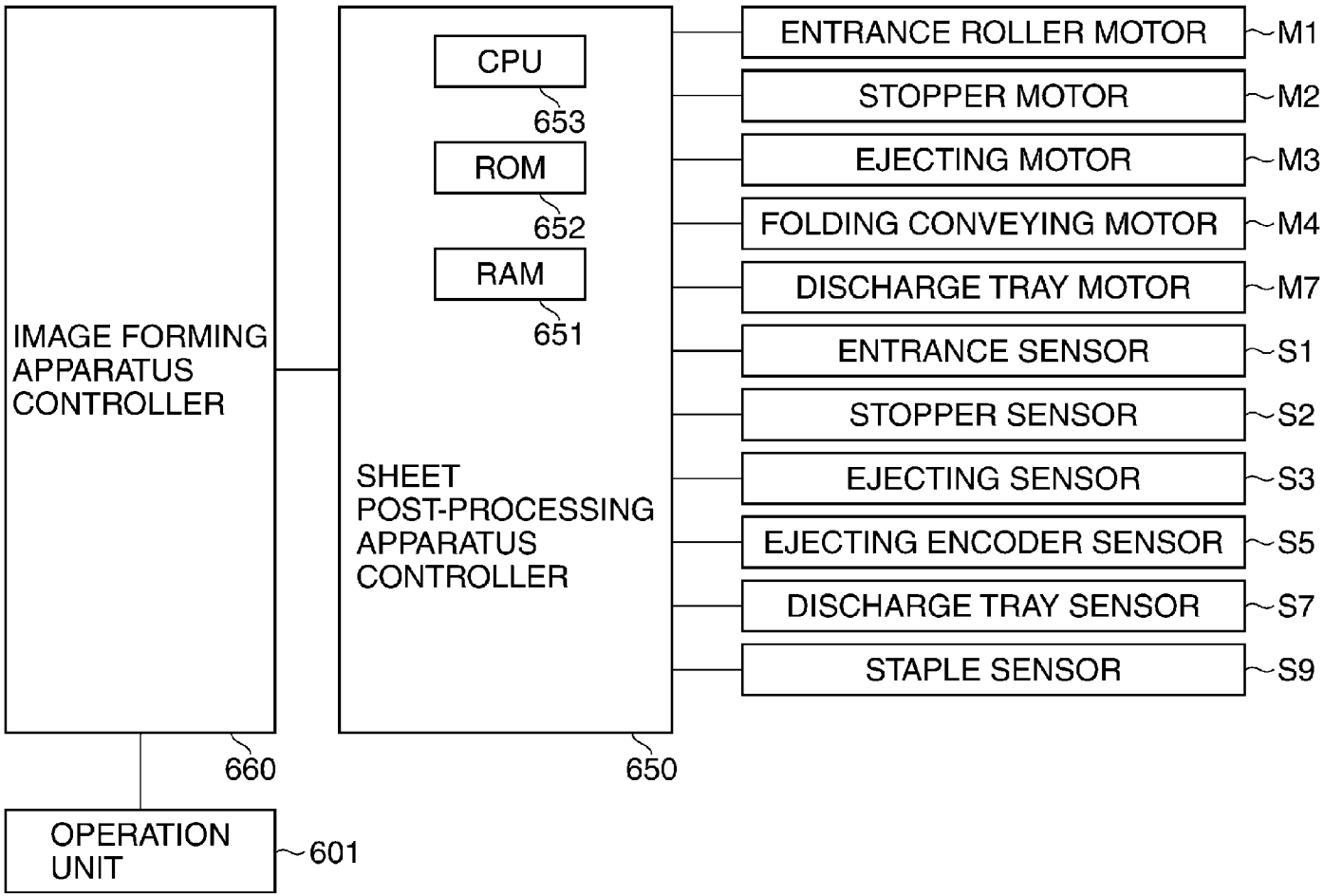
FIG. 5 is a block diagram showing an exemplary control system of the image forming apparatus appearing in FIG. 1.

FIG. 5 is a block diagram showing an exemplary control system of the image forming apparatus appearing in FIG. 1.

Referring to FIG. 5, an image forming apparatus controller 660 is installed in the image forming apparatus main body 600. The sheet post-processing apparatus controller 650 is, for example, installed in the sheet post-processing apparatus (saddle stitching apparatus) 500 and communicates with the image forming apparatus controller 660 to exchange data.

The sheet post-processing apparatus controller 650 has a CPU 653, a ROM 652, and a RAM 651. The CPU 653 controls the sheet post-processing apparatus 500 by executing various programs stored in the ROM 652 based on instructions from the image forming apparatus controller 660. The RAM 651 is used as, for example, a work area for the CPU 653.

As shown in the figure, connected to the sheet post-processing apparatus controller 650 are the entrance roller motor M1, the stopper motor M2, the ejecting motor M3, the folding conveying motor M4, the discharge tray motor M7, the entrance roller sensor S1, the stopper sensor S2, the ejecting sensor S3, the ejecting encoder sensor S5, the discharge tray sensor S7, and the staple sensor S9. The CPU 653 drivingly controls the motors according to results of detection by the above respective sensors.

Figure 6B:
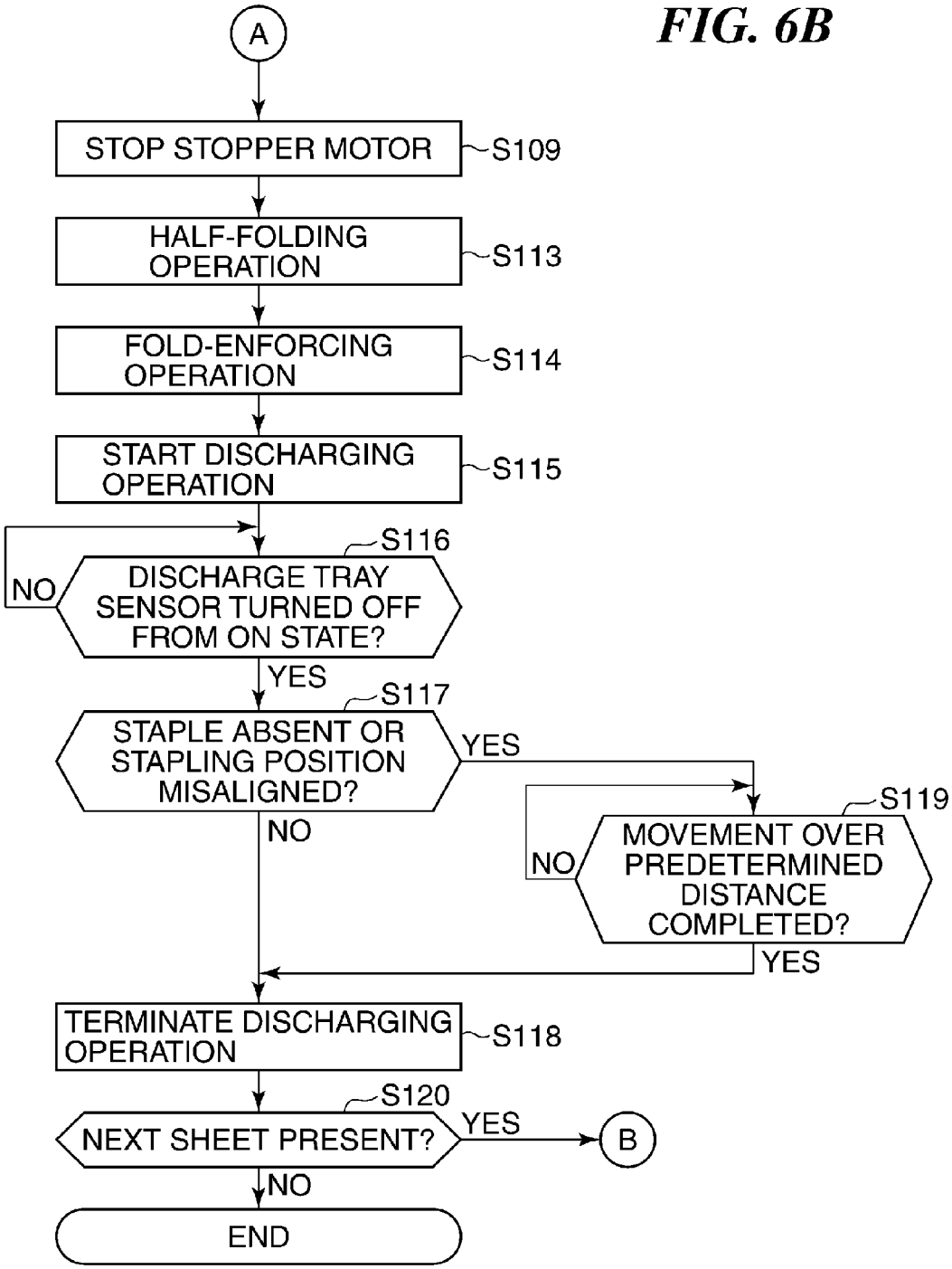

FIGS. 6A and 6B are flowcharts useful in explaining sheet post-processing carried out by the sheet post-processing apparatus controller 650 appearing in FIG. 5. Processes in the flowcharts are carried out by the CPU 653. It should be noted that in the following description, a bookbinding process is taken as an example of sheet post-processing.

When the bookbinding process is started, the CPU 653 drivingly controls the stopper motor M2 to move the end stopper 805 to a position that is a correction value S (mm) above a reference position corresponding to a sheet size (S101). Namely, according to the correction value (also referred to as the correction amount) S, the CPU 653 changes the position at which a sheet bundle is stacked. It should be noted that the correction value S is a value that is determined in the previous stapling process and held even when the power to the sheet post-processing apparatus is turned off.

It should be noted that the reference position is such a position of the end stopper 805 that the central part of a sheet corresponds to the position of the stapler 820 in the sheet conveying direction. Also, as will be described later, the correction value (correction amount) S means a difference (deviation) between the central part of a sheet bundle and a stapling position (stitching position).

Thus, by correcting the position of the end stopper 805 by the amount of deviation of the stapling position with respect to the reference position corresponding to the sheet size, the stapling position for the next sheet bundle can be aligned with the central part of the sheet bundle. When the stapling position is in alignment, that is, when the amount of deviation is zero, the correction value S is zero.

Then, the CPU 653 controls the components of the sheet post-processing apparatus 500 such that a set number of sheets are stacked as a sheet bundle in the housing guide 803 (S102). Information on the set number of sheets (the number of sheets constituting a sheet bundle) is sent from the image forming apparatus controller 660 to the sheet post-processing apparatus controller 650.

When stacking (mounting) of sheets corresponding in number to the number of sheets constituting a bundle is completed, the CPU 653 controls the stapler 820 to perform stapling on the sheet bundle (S103). Then, the CPU 653 drives the stopper motor M2 to start moving the sheet bundle to a half-folding position (S104). The CPU 653 then starts counting drive pulses that are supplied to the stopper motor M2 so as to measure the moving distance of the end stopper 805, that is, the moving distance of the sheet bundle (S105).

Then, the CPU 653 ascertains whether or not a staple has been detected by the staple sensor S9 during the movement of the sheet bundle (S106). When no staple has been detected (NO in the step S106), the CPU 653 ascertains whether or not the moving distance of the sheet bundle has reached a predetermined moving distance (for example, (L+M) mm) by counting drive pulses (S107).

Figure 7:
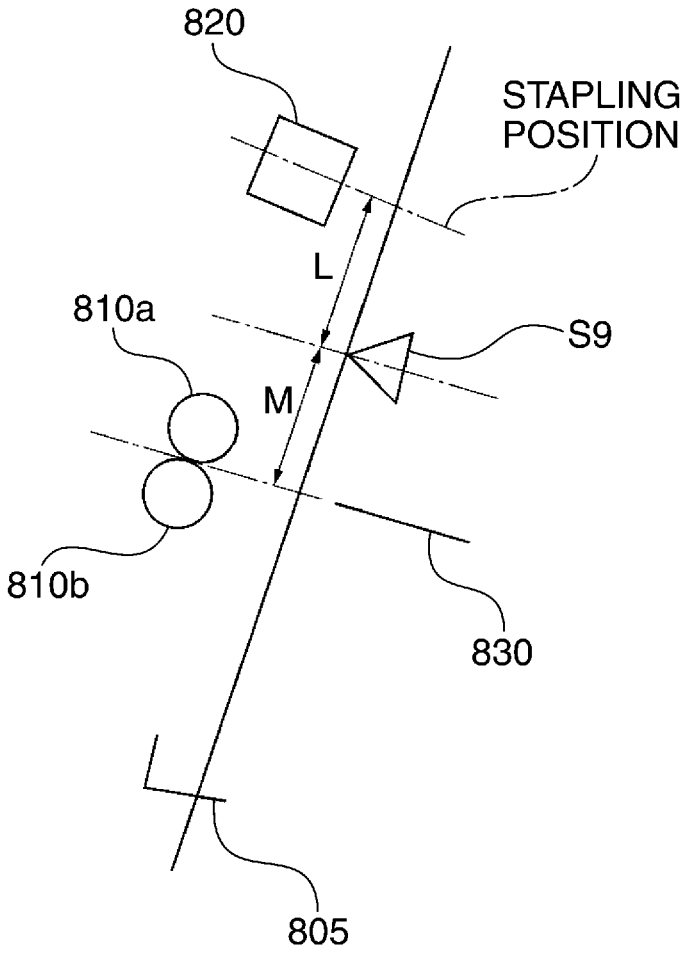
FIG. 7 is a view useful in explaining a positional relationship when a sheet bundle is moved over a predetermined distance through operation of a stopper motor appearing in FIG. 5.

FIG. 7 is a view useful in explaining a positional relationship in a case where a sheet bundle is moved over a predetermined distance through operation of the stopper motor M2 appearing in FIG. 5.

Referring to FIG. 7, "L" designates a distance for reference (reference distance) from a stapling position to the staple sensor S9. "M" designates a distance from the staple sensor S9 to a folding position (folding process position) at which the ejecting member 830 abuts on the sheet bundle.

When the moving distance of the sheet bundle has not reached the predetermined moving distance (NO in the step S107), the CPU 653 returns to the process in the step S107, in which it ascertains whether or not there is a staple (stitching staple). In this way, the CPU 653 ascertains whether or not there is a staple until the moving distance of the sheet bundle has reached the predetermined moving distance.

When the presence of a staple is not detected until the moving distance of the sheet bundle has reached the predetermined moving distance (YES in the step S107), the CPU 653 determines that stapling has not been successfully performed and notifies the image forming apparatus controller 660 of the abnormality (S108). As a result, the image forming apparatus controller 660 displays the notification of the abnormality on the operation unit 601. Then, in response to the moving distance of the sheet bundle having reached the predetermined moving distance, the CPU 653 stops the stopper motor M2 (S109). At this time, the stapling position of the sheet bundle shifts to the folding position. It should be noted that even when the notification of the abnormality is provided in the step S108, the bookbinding process is continued.

When the presence of the staple is detected until the moving distance of the sheet bundle has reached the predetermined moving distance (YES in the step S106), the CPU 653 obtains a count of drive pulses to the stopper motor M2 (S110). Then, according to the count of drive pulses, the CPU 653 obtains, as a measured distance A, the moving distance of the end stopper 805, that is, the moving distance of the sheet bundle. The measured distance A represents the distance from the actual stapling position, at which stapling was performed, to the staple sensor S9. When the stapler 820 is not out of alignment with the reference position, the measured distance A is equal to the reference distance L. However, when the stapler 820 is out of alignment with the reference position, the measured distance A is unequal to the reference distance L.

Next, the CPU 653 obtains the amount of deviation (that is, the correction amount S) described above according to the reference distance L and the measured distance A described above. Here, the CPU 653 obtains the correction amount S, that is, the amount of deviation of the staple using the following equation, the correction amount (deviation) S=the reference distance L−the measured distance A (S111). It should be noted that the correction amount S is stored in, for example, the RAM 651 and used in bookbinding a subsequent sheet bundle.

The CPU 653 then ascertains whether or not the sheet bundle has moved by a distance prescribed in advance (M mm) since the staple sensor S9 detected the staple (S112). When the sheet bundle has not moved by the distance prescribed in advance (NO in the step S112), the CPU 653 stands by. On the other hand, when the sheet bundle has moved by the distance prescribed in advance (YES in the step S112), the CPU 653 proceeds to the process in the step S109, in which it stops the stopper motor M2.

Then, in the above described way, the CPU 653 carries out a half folding operation in which it folds the sheet bundle in two (S113). Even when no staple has been detected, the half folding operation is carried out. Further, the CPU 653 carries out a fold enforcing operation in which it enforces a fold (S114) and starts discharging the sheet bundle (S115).

Upon starting discharging the sheet bundle, the CPU 653 ascertains whether or not the discharge tray sensor S7 has changed from the ON state to the OFF state (S116). When the discharge tray sensor S7 has not changed from the ON state to the OFF state (NO in the S116), the CPU 653 stands by.

When the discharge tray sensor S7 has changed to the OFF state (YES in the S116), the CPU 653 ascertains whether or not notification of an abnormality (that is, the absence of a staple) has been provided or the correction amount S has become greater than a predetermined amount (predetermined value) (S117). When the correction amount S has become greater than the predetermined amount, the CPU 653 determines that deviation of the stapling position (deviation of the binding needle position) has occurred.

When notification of an abnormality has not been provided and the stapling position has not become misaligned (that is, the correction amount S is equal to or smaller than the predetermined amount) (NO in the step S117), the CPU 653 stops the discharge motor M7 at the time of this ascertaining (terminates the discharging operation: S118). Then, the CPU 653 determines whether or not there is a subsequent (next) sheet (S120). When there is no next sheet (NO in the S120), the CPU 653 terminates the bookbinding process. On the other hand, when there is a next sheet, the CPU 653 returns to the process in the step S101.

When notification of an abnormality has been provided or the stapling position has become misaligned (YES in the step S117), the CPU 653 determines whether or not the discharge tray motor M7 has been driven for a predetermined time period corresponding to a predetermined distance so the sheet bundle (that is, the book) can be easily distinguished from a normal sheet bundle (S119).

When the discharge tray motor M7 has not been driven for the predetermined time period (NO in the step S119), the CPU 653 stands by. When the discharge tray motor M7 has been driven for the predetermined time period (YES in the step S119), the CPU 653 proceeds to the process in the step S118, in which it stops the discharge tray motor M7.

Thus, when there is no staple or when the stapling position has become misaligned, the distance by which a sheet bundle is discharged on the tray is increased so that the user can easily find an abnormal sheet bundle.

As described above, at the time of stopping a sheet bundle at the folding position, the sheet post-processing apparatus according to the embodiment of the present invention controls the stop position according to a result of staple detection by the staple sensor. Therefore, the stapling position and the folding position can be brought into alignment with high accuracy.

In addition, because the sheet post-processing apparatus according to the embodiment of the present invention obtains a correction amount by measuring the amount of deviation of a staple from the central part of a sheet bundle and uses this correction amount in controlling the stop position of the end stopper 805 at the time of bookbinding a next sheet bundle, an accuracy for a staple to be driven through the central part of the sheet bundle can be enhanced.

In the embodiment described above, even when no staple is detected, processing is continued as long as there is a next sheet bundle. However, when no staple is detected, the CPU 653 may notify the image forming apparatus controller 660 of an instruction to suspend new image formation so as to suspend the bookbinding process.

As is apparent from the above description, in the example shown in FIGS. 2 and 5, the end stopper 805, the stopper motor M2, and the CPU 653 act as a sheet bundle moving unit. The CPU 653 also acts as a measurement unit and a correction value calculation unit. Further, the CPU 653 acts as a stop unit, an abnormality notification unit, and a discharge control unit. The CPU 653 and the discharge tray motor M7 act as a discharging and conveying unit.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-018341 filed Jan. 31, 2012, which is hereby incorporated by reference herein in its entirety.

What is claimed is:

1. A sheet post-processing apparatus that carries out a stapling process on a plurality of sheets, comprising:

a sheet stacking unit configured to have the plurality of sheets stacked thereon as a sheet bundle;

a sheet stapling unit configured to stapling the sheet bundle, stacked on said sheet stacking unit, using a binding needle at a stapling process position at which the stapling process is carried out;

a folding process unit configured to, after the stapling process, carry out a folding process in which the sheet bundle is folded at a position of the binding needle;

a binding needle detection unit configured to be disposed at a predetermined location between the stapling process position and a folding process position at which the folding process is carried out, and detect the binding needle;

a sheet bundle moving unit configured to move the sheet bundle from the stapling process position to the folding process position; and a correction unit configured to, based on a moving distance of the sheet bundle before the binding needle is detected by said binding needle detection unit after the stapling process by said sheet stapling unit, corrects a position of a subsequent sheet bundle with respect to said sheet stapling unit in the stapling process for the subsequent sheet bundle.

2. A sheet post-processing apparatus according to claim 1, wherein said correction unit corrects the position of the sheet bundle based on a difference between the moving distance and a reference distance.

3. A sheet post-processing apparatus according to claim 2, wherein the reference distance is a distance between a reference position of said sheet stapling unit and said binding needle detection unit.

4. A sheet post-processing apparatus according to claim 2, further comprising an abnormality notification unit configured to, when the difference becomes greater than a predetermined value, provide notification that deviation of a stapling position has occurred.

5. A sheet post-processing apparatus according to claim 1, further comprising an abnormality notification unit configured to provide notification of an abnormality when the binding needle is not detected by said binding needle detection unit until the sheet bundle is moved from the stapling process position to the folding process position by said sheet bundle moving unit.

6. A sheet post-processing apparatus according to claim 2, further comprising:

a discharging and conveying unit configured to convey the sheet bundle to a discharging unit after the folding process is carried out; and a discharge control unit configured to, when the difference becomes greater than a predetermined value, drive said discharging and conveying unit for a time period that is a predetermined time period longer than in a case where the difference is equal to or smaller than the predetermined value.

7. A sheet post-processing apparatus according to claim 1, further comprising:

a discharging and conveying unit configured to convey the sheet bundle to a discharging unit after the folding process is carried out; and a discharge control unit configured to, when the binding needle is not detected by said binding needle detection unit until the sheet bundle is moved from the stapling process position to the folding process position by said sheet bundle moving unit, drive said discharging and conveying unit for a time period that is a predetermined time period longer than in a case where the binding needle is detected by said binding needle detection unit.

8. A control method for a sheet post-processing apparatus that has a sheet stacking unit having a plurality of sheets stacked thereon as a sheet bundle; carries out a stapling process on the sheet bundle, comprising:

a sheet stapling step of driving a stapler to staple the sheet bundle, stacked on the sheet stacking unit, using a binding needle at a stapling process position at which the stapling process is carried out;

a folding process step of carrying out a folding process in which the sheet bundle is folded at a position of the binding needle after the stapling process;

a moving step of, after the stapling process, moving the sheet bundle from the stapling process position to the folding process position;

a binding needle detection step of, during the movement in said moving step, detecting the binding needle using a binding needle sensor disposed at a predetermined location between the stapling process position and a folding process position at which the folding process is carried out; and a correction step of, based on a moving distance of the sheet bundle before the binding needle is detected by the binding needle sensor after the stapling process, correcting a position of the sheet bundle with respect to the stapler in the stapling process for a subsequent sheet bundle.

* * * * *